United States Patent [19]

Paddock

[11] 4,060,984

[45] Dec. 6, 1977

[54] AIR SWITCHING DIVERTER VALVE

[75] Inventor: Gordon R. Paddock, Rochester, N.Y.

[73] Assignee: General Motors Corporation, Detroit, Mich.

[21] Appl. No.: 734,977

[22] Filed: Oct. 22, 1976

[51] Int. Cl.[2] ..... F01N 3/10

[52] U.S. Cl. ..... 60/290

[58] Field of Search ..... 60/289, 290; 123/119 A

[56] References Cited

U.S. PATENT DOCUMENTS

| | | | |
|---|---|---|---|
| 3,888,222 | 6/1975 | Tomita | 123/119 A |
| 3,905,193 | 9/1975 | Heilman | 60/290 |
| 3,924,408 | 12/1975 | Beiswenger | 60/290 |
| 3,948,045 | 4/1976 | Budinski | 60/290 |
| 3,974,807 | 8/1976 | Nohira | 123/119 A |
| 3,982,515 | 9/1976 | Bradshaw | 123/119 A |

*Primary Examiner*—Douglas Hart
*Attorney, Agent, or Firm*—Arthur N. Krein

[57] ABSTRACT

An air switching diverter valve assembly for use with an internal combustion engine to control the flow of secondary air from an air pump, the air switching diverter valve assembly including a housing having a valve chamber therein with an inlet from the air pump to the valve chamber, a first outlet to supply air to the engine exhaust manifold, a second outlet to supply air either to the converter or to the atmosphere, depending on the intended use of the valve in an engine system, and a pressure valve controlled third outlet, a valve movably positioned in the valve chamber for control of flow out through either the first outlet or the second outlet, a switching diaphragm assembly being operatively connected to the valve for actuation thereof and positioned in the housing to form therewith first and second chambers on opposite sides of the switching diaphragm, the second chamber being connected to receive an engine manifold vacuum signal and, a divert timing assembly positioned in the second chamber and attached to one side of the switching diaphragm whereby vacuum leakage from this air switching diverter valve assembly is reduced to a minimum.

4 Claims, 2 Drawing Figures

AIR SWITCHING DIVERTER VALVE

Figure 1:
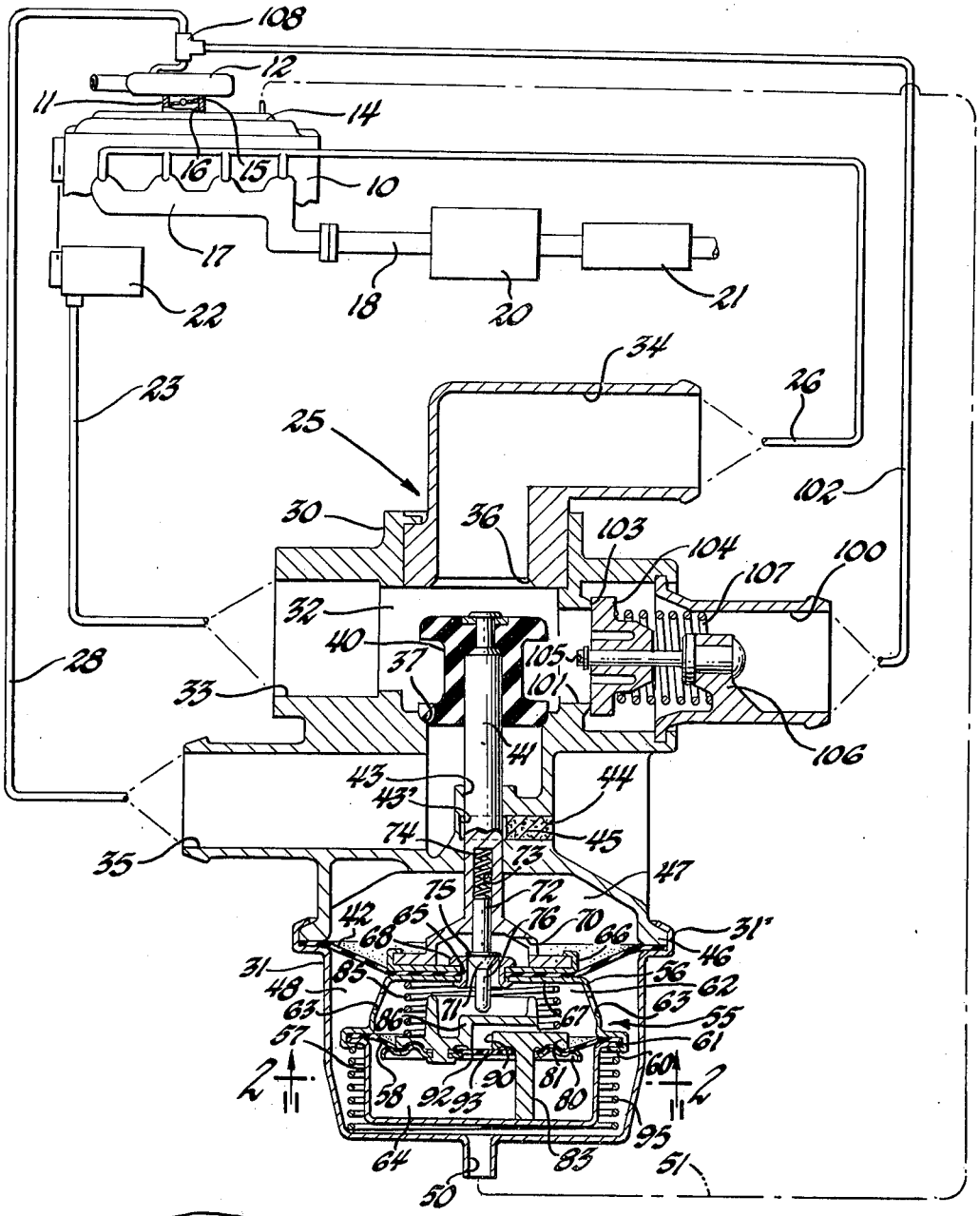

This invention relates to an air control valve for use in a system which delivers air from an air pump to the exhaust system of an internal combustion engine and, in particular, to an air switching diverter valve for selectively switching the flow of secondary air either to the exhaust manifold of the engine or to another component associated with the engine, such as the air cleaner thereof or the converter in the exhaust system for the engine.

In the air switching and diverter valve assemblies of the known prior art, it has been customary to use a zinc die-cast housing or other type of molded housing as one element of such an assembly to contain some of the elements of the valve assembly used to effect switching and an additional housing, where a divert timing assembly is used, to house at least some of the elements of the divert timing assembly. Since one of the chambers formed in part by the switching diaphragm may be supplied with engine vacuum pressure and since the divert timing assembly is also normally operated as a function of engine vacuum, appreciable manifold vacuum pressure may leak from such an assembly.

Accordingly, the primary object of this invention is to improve an air switching diverter valve assembly so that vacuum leakage therefrom is kept to a minimum.

Another object of this invention is to provide an improved air switching diverter valve assembly wherein the divert timing assembly is supported by the switching diaphragm of such an assembly within a chamber enclosed in part by the switching diaphragm.

These and other objects of the invention are obtained in an air switching diverter valve assembly for use with an internal combustion engine for controlling flow of secondary air wherein the air switching diverter valve assembly includes a housing having a valve chamber therein with an inlet to the air chamber, a first outlet, a second outlet and a pressure valve controlled third outlet, with a valve movably positioned in the valve chamber for the control of flow through either the first outlet or the second outlet, a switching diaphragm is operatively connected to the valve and is positioned in the housing to form therewith a chamber open through a bleed orifice to the atmosphere on one side of the switching diaphragm and an actuating or vacuum chamber on the opposite side thereof, the switching diaphragm having a central aperture therethrough in communication on one side with the pressure chamber and on its opposite side to the vacuum chamber of a divert timing assembly fixed to the switching diaphragm, with flow through the central aperture being controlled by a control valve that is spring biased to normally block flow through the aperture and which has a stem portion extending down into the vacuum chamber of the divert timing assembly to be engaged and moved by an element of the divert timing valve assembly.

Figure 2:
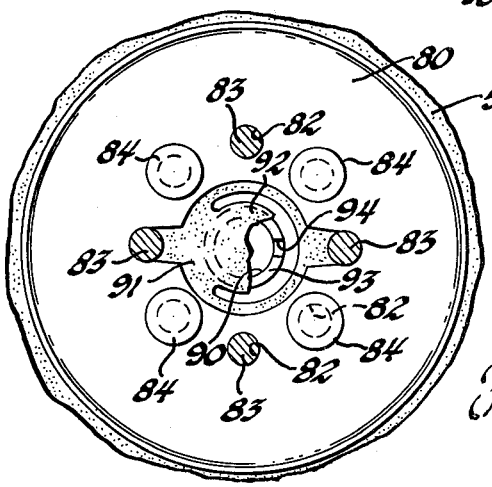

For a better understanding of the invention, as well as other objects and further features thereof, reference is had to the following detailed description of the invention to be read in connection with the accompanying drawings, wherein:

FIG. 1 is a schematic view of an internal combustion engine having an air pump for delivering secondary air and an air switching diverter valve, in accordance with the invention, for controlling the delivery of secondary air to various components of the engine, this valve assembly being shown in enlarged, sectional, elevational view and with the elements thereof positioned, as during engine operation, to direct secondary air flow to the exhaust manifold of the engine; and, FIG. 2 is a view taken along line 2—2 of FIG. 1 to show the divert timing valve arrangement of the divert timing valve of the air switching valve assembly.

Referring now to FIG. 1, an internal combustion engine 10 is provided, for example, with a carburetor 11 and an air cleaner 12 mounted thereon to supply an air-fuel mixture to the intake manifold 14 of the engine, primary air flow through the carburetor to the engine being controlled by a throttle valve 15 pivotal within the induction passage 16 of the carburetor. An exhaust manifold 17 receives the exhaust gases discharged through the exhaust ports (not shown) from the cylinders (not shown) of the engine and defines a flow path for the combustible exhaust gases discharged therefrom. Each exhaust manifold 17 is connected to an exhaust pipe 18 which, in turn, is connected to a catalytic converter 20 and a muffler 21.

An air pump, such as engine driven air pump 22, delivers secondary air via a conduit 23 to an air switching diverter valve, generally designated 25, in accordance with the invention, which is connected for a so-called power mode use relative to the engine. In such an arrangement for power mode use, the air switching diverter valve is operative, in a manner to be described, to effect delivery of secondary air either through a conduit 26 to the exhaust manifold 17 wherein discharge thereinto closely adjacent to the exhaust ports (not shown) of the engine on the downstream side thereof or, through a conduit 28 to, preferably, the dirty side of the air cleaner 12.

The air switching diverter valve 25, in the construction illustrated, includes a valve housing having as major elements thereof an upper body 30 and a lower cup-shaped cover 31 suitably secured together, in a manner to be described. The upper body 30 is formed with a central valve chamber 32 adjacent to the upper end of the body with a lateral inlet 33 opening into the chamber, the inlet being connected by the conduit 23 to the air pump 22. The upper body is also provided with a first or primary outlet 34, of L-shaped configuration in cross section, with one end of this first outlet opening into the valve chamber 32 and its opposite end being connected by the conduit 26 to the exhaust manifold and with a second or secondary outlet 35, also of L-shape when viewed in cross section opening at one end into the valve chamber and being connected at its opposite end when used for power mode use, as illustrated in FIG. 1, by a conduit 28 to the air cleaner 12. An upper annular valve seat 36 in the upper body in the valve chamber surrounds the first outlet, which valve seat is concentric to and in axial alignment with a second valve seat 37 in the valve chamber surrounding the second outlet.

A valve chamber 40 is positioned in the valve chamber 32 for movement therein and is secured to the upper end of a valve stem 41 thereby into engagement with either valve seat 36 or valve seat 37, with the flanged lower end of the valve stem being suitably secured, in a manner to be described, to a switching diaphragm 42. The valve stem 41 is loosely guided for reciprocal movement in a valve guide bore 43 extending through a lower portion of the upper body 30. The annular inner peripheral wall provided by the guide bore 43 operates as a bearing surface for the valve stem 41 with a predetermined clearance existing between these surfaces to provide a leak path between the valve stem and the bearing surface. A radial port 44 in the upper body at one end thereof intersects an annular recess 43' in the guide bore 43 and is open at its opposite end to the atmosphere. A filter 45 is positioned in the radial port 44 to prevent dust, dirt or other contaminants from reaching either the valve stem 41 or the bearing surface provided by the guide bore.

In the construction shown, the upper rim 31' of the cover 31 is spun over the lower rim 46 of the upper body 30, with the outer peripheral surfaces of the switching diaphragm 42 sandwiched therebetween whereby the switching diaphragm forms with the lower cup-shaped portion of the upper body a pressure chamber 47 which is always in communication via the above described leak path between the valve stem 41 and the bearing surface provided by the bore 43 and via the radial port 44 with the atmosphere, while the switching diaphragm 42 forms with the cover 31 a lower actuating or vacuum chamber 48, this chamber being connected by an outlet 50 to the cover 31 and by a conduit 51 to a source of engine vacuum downstream of the throttle valve, as by having the conduit 51 connected to the intake manifold 14.

In accordance with the invention, a divert timing assembly, generally designated 55, is loosely positioned within the vacuum chamber 48 and is secured to the switching diaphragm 42 for movement therewith. The divert timing assembly 55 includes a two-piece divert housing including an upper cup-shaped housing member 56 and a lower cup-shaped housing member 57 suitably secured together with a divert timing diaphragm 58 sandwiched therebetween. In the construction illustrated, the lower, flange-like rim 60 of the upper housing member 56 is spun over the upper rim 61 of the lower housing member 57. The divert timing diaphragm 58 forms with the upper housing member 56 a divert vacuum chamber 62 that is in communication, via the openings 63 in the side walls of the upper housing member 56, with the vacuum chamber 48, and this diaphragm 58 forms with the lower housing member 57 a timing chamber 64.

Referring again to the switching diaphragm 42, it is provided with a central circular aperture 58 therethrough and it is sandwiched between a diaphragm retainer washer 66 fixed to the flanged end of the valve stem 41 and the apertured base 67 of the upper housing member 56, with these elements being secured together by means of a tubular rivet 68. An open passage 70 is provided in the flanged end of the valve stem 41 to be in communication with the upper end of the tubular rivet 68 whereby there is provided a control passage which interconnects the divert vacuum chamber 62 with the pressure chamber 47, for a purpose which will become apparent. Flow through this control passage is controlled by means of a valve 71 positioned to cooperate with the tubular rivet 68 to regulate flow through the opening therethrough. As shown, the valve 71 has a stem 72 extending from one side of the head thereof, this stem 72 being reciprocably received in a guide bore 73 within the valve stem 41, a spring 74 being positioned in the guide bore 73 so as to engage the stem 72 whereby to normally bias the head of the control valve 71 into seating engagement with the annular seat 75 provided at one end of the tubular rivet 68. A second stem portion 76 depends from the opposite side of the head of the control valve 71 to extend through the tubular rivet 68 and down into the divert vacuum chamber 62 for a purpose to be described.

Referring now again to the divert timing assembly, the divert timing diaphragm 58 has its central portion fixed between a diaphragm retaining ring or washer 80 and a plate member 81, the washer 80 being on the timing chamber side of the diaphragm while the plate 81 is on the divert vacuum chamber side thereof. The washer 80 is provided, as best seen in FIG. 2, with a plurality of apertures 82 which receive the aligned pins 83 formed to extend from the lower portion of the plate member 81. Four of these alignment pins 83 are of relatively short length and are riveted as at 84 to retain the washer 80 to the plate member 81 with the diaphragm 58 sandwiched therebetween. At least one of the other alignment pins, and preferably all of the remaining alignment pins 83, are of a suitable length so as to be engageable with the inner bottom surface of the lower body member 57 whereby to limit movement of the diaphragm 58 assembly in one direction, the downward direction with reference to FIG. 1.

The divert timing diaphragm 58 and the elements carried thereby are normally biased to the position shown in FIG. 1, with the long alignment pins 83 then engaging the inner bottom surface of the lower body member 57, by means of a coiled spring 85 that is positioned in the divert vacuum chamber 62 with one end of the spring abutting the base 67 of upper body member 56 and its other end abutting against the plate 81. In this position, the web 86 of the disk 81 is positioned to be out of engagement with the stem 76 of the control valve 71 whereby this control valve can thus be biased by the spring 74 to a position blocking flow through the passage 70, the position as shown in FIG. 1.

Plate member 81 is provided with a passage 90 therein which is used to connect the divert vacuum chamber 62 with the timing chamber 64, a flat type check valve 91 being positioned to regulate flow through the passage 90 into the timing chamber 64. The details of the check valve 91 are most clearly seen in FIG. 2. As shown, the outer rim of the check valve 91 is supported by the inner rim of the washer 80. A central flap 92 of the check valve overlies an annular valve seat 93 formed in the base of the plate member 81. A notch 94 is coined in the seat 93. During the period when manifold vacuum in divert vacuum chamber 62 is increasing, flow from the timing chamber 64 through the passage 90 to the divert vacuum chamber 62 is restricted to pass only through the notch 94. Thus, the volume of the timing chamber 64 and the size of the notch 94 determine the time required for the pressure in timing chamber 64 to be reduced to the point where the spring 85 will lower diaphragm 58 to the position shown in FIG. 1. During a period of increasing pressure in the divert vacuum chamber 62, the central flap 92 will be pushed downwardly to allow unrestricted flow from the chamber 62 through the passage 90 to the timing chamber 64 and thus permit immediate return of the diaphragm 58 and therefore plate 81 to the position shown by the spring 85.

Referring again to the valve member 40, it is normally biased to a position in engagement with the valve seat 36 whereby to block flow out through the first outlet 34 while permitting flow out through the second outlet 35 by means of a coiled spring 95 positioned in the vacuum chamber 48 to engage the divert timing assembly so as to also effect support of this divert timing assembly within the vacuum chamber 48. As shown, one end of the spring 95 abuts against the lower base of the cover 31 while its opposite end engages the rim 60 of the flange connection between the upper and lower housing members 56 and 57, respectively. The spring 95 is calibrated with a suitable spring force so as to effect movement of the valve member 40 from the position shown into seating engagement with the valve seat 36 to block flow to the exhaust manifold when manifold vacuum goes down to or below a predetermined vacuum level.

As shown, the upper body 30 of the valve housing is also provided with a pressure relief outlet 100 extending from a lateral opening 101 disposed from the side of the valve chamber 32 diametrically opposite inlet 33, with the outlet 100 being connected by a conduit 102 for discharge into the air cleaner 12 on the dirty side thereof. A valve seat 103 is provided about the opening 101 and is engaged by a valve 104 slidably mounted on a shaft 105 which has one end thereof fixed to a radial boss 106 of the upper body 30. The pressure relief feature is provided by a calibrated spring 107 which normally biases the valve member 104 against the seat 103. In the construction illustrated, both the conduit 28 and the conduit 102 are connected to the air cleaner by a T-connection 108, although it should be realized that these conduits could be separately connected to the air cleaner.

As previously described, the valve member 40 is normally biased by the spring 95 to a position at which the valve member 40 engages the valve seat 36 to block flow through the primary discharge outlet 34 while permitting flow out through the secondary outlet 35 and thus, anytime when there is no signal vacuum provided to the actuating chamber 48 or when the vacuum signal goes down to or below a specific level, as determined by the selected rate of spring 95, switching from the primary discharge outlet 34 to the secondary discharge outlet 35 will occur.

Of course, during engine operation, a signal vacuum will be provided to the vacuum or actuating chamber 48 via the conduit 51, as previously described. Also, as previously described, the divert vacuum chamber 62 is always open to the chamber 48 by means of the openings 63. The timing chamber 64 is exposed to the divert vacuum chamber 62 and thus to the chamber 48 only through the disk valve 91 and the bleed notch 94 which provides a tiny bleed flow between these chambers for the timing function, to be described. In addition, as previously described, the pressure chamber 47 is always open to the atmosphere through the leak path as provided between the valve stem 41 and the bearing surface provided by the bore 43 in the upper body 30 and, in a particular embodiment, this leak path is equivalent to a 0.041 inch diameter hole. The filter 45 in the radial port 44 and the wiping action of the valve stem 41 on the bearing surface in the upper body, as provided by the bore 43, will keep this leak path open.

The spring 95 is of course calibrated to effect shutting off of the air flow through the primary discharge outlet 34 to the exhaust manifold 17 whenever manifold vacuum in the chamber 48 goes down to or below a predetermined specific level. Thus, with the engine operating and the vehicle operated in the stabilized driving mode, when manifold vacuum signal supplied to the chamber 48 is above this specific level, the pressure differential on opposite sides of the switching diaphragm 42 will cause the valve member 40 to move to the position shown in FIG. 1 with the valve member 40 then seated against the valve seat 37 to block flow out through the secondary discharge outlet 35 while permitting air flow, as delivered by the pump 22, to be discharged out through the primary outlet to the exhaust manifold. In such a stabilized driving mode, the manifold vacuum in the timing chamber 64 would be equal to that in chambers 62 and 48.

On a deceleration, the vacuum chamber 48 and, of course, the divert vacuum chamber 62 would be immediately exposed to high manifold vacuum. Since the timing chamber 64 is exposed to the divert vacuum chamber 62 only through the tiny bleed passage as provided by the notch 94, an immediate pressure differential will become effective across the divert timing diaphragm 58. This force will be sufficient to move the divert timing assembly upward, with reference to FIG. 1, against the biasing action of the spring 85, whereby the web 86 of the plate member 81 engages the second stem portion 76 of the valve 71 to effect its unseating so as to connect the divert vacuum chamber 62 via the passage 70 with the pressure chamber 47 thus exposing this latter chamber to this high manifold vacuum.

Since the only leakage to the atmosphere from the pressure chamber 47 is via the very small leak path between the valve stem 41 and the bearing surface therefor in the upper body, the vacuum signal will be maintained in the pressure chamber 47 so that this will be substantially equalized with the vacuum pressure in the vacuum chamber 48 and thus there will be substantially no pressure differential across the switching diaphragm 42 and, therefore, the bias of spring 95 will cause the entire divert timing assembly and switching assembly to move upward, with reference to FIG. 1, to position the valve chamber 40 so as to shut off the air flow out through the primary discharge outlet 34 to the exhaust manifold and permit air flow then to be discharged out through the secondary outlet 35.

As the air in timing chamber 64 bleeds through the notch 94 to the chamber 62, the pressure differential across the divert timing diaphragm 58 will decrease down to a level where the bias of the spring 85 acting against the divert timing diaphragm 58, and the bias of spring 74 will cause the valve 71 to approach its seat 75 and to be finally seated thereagainst. The timing for this is controlled by the size of the bleed notch 94 that is coined in the valve seat 93 and the value of spring 85. When the valve 71 is seated, manifold vacuum is shut off from the pressure chamber 47 and then atmospheric pressure will be maintained in this chamber via the bleed path previously described. This then causes a sufficient differential pressure to occur across the switching diaphragm 42 to act against the bias of the spring 95 whereby to then effect movement of the valve member 40 to the position, as shown in FIG. 1, blocking flow through the secondary outlet 35 while permitting air flow again out through the primary outlet 34 to the exhaust manifold. This is the timing cycle to prevent backfires during decelerations.

On large throttle openings, such as during accelerations, for example, manifold vacuum supplied to the vacuum chamber 48 will drop to a low level. As previously described, the spring 95 is calibrated for a certain specific low value or level of manifold vacuum and when the vacuum signal drops down to or below this level, the bias of spring 95 will overcome the force caused by any differential pressure across the switching diaphragm 42 and the force due to pump pressure over the effective area of the valve member 40. The spring 95 will then effect movement of the valve member 40 to a position at which it is seated against the valve seat 36 to shut off air flow to the exhaust manifold while permitting air to be again discharged out through the secondary outlet 35.

If the throttle valve 15 is eased off gradually so that the increase in manifold vacuum is gradual, the pressure differential across switching diaphragm 42 will increase and when the vacuum signal reaches or goes above the level that the spring 95 is calibrated for, the differential force across the switching diaphragm 42 will overcome the bias of the spring 95 and cause the valve member 40 to move to the position shown in FIG. 1 and allow air flow through the primary outlet 34 to the exhaust manifold while shutting off air flow through the secondary outlet 35.

If the manifold vacuum increase above the calibrated level is great and sudden, such as on a closed throttle deceleration, the divert timing assembly consisting of diaphragm 58, spring 85 and the valve 71 will go through the timing cycle, as previously explained. It should, however, be noted that the opening and closing of the valve 71 due to deceleration acts independently from the bias of the spring 95. The valve member 40 will be moved to effect opening of the primary discharge outlet 34 and to block flow through the secondary outlet 35 only when the timing cycle has been completed.

On accelerations, if manifold vacuum suddenly decreases below the vacuum level present in the timing chamber 64, the central flap 92 of the check valve 91 will become unseated to allow the pressure in the timing chamber 64 to be immediately equalized with the pressure in the divert vacuum chamber 62 and, of course, to the pressure in vacuum chamber 48. The operation of the check valve 91 is such that it opposes a sudden decrease in pressure in the timing chamber 64 but allows a sudden increase of pressure therein.

As previously described, on deceleration, the valve 71 is opened to expose the pressure chamber 47 to the manifold vacuum in the vacuum chamber 48 whereby to effect movement of the valve member 40 into seating engagement with the valve seat 36 so as to block air flow out through the primary discharge outlet to the exhaust manifold while permitting air to be discharged out through the secondary discharge outlet 35. However, during the timing cycle when there is a sudden hard acceleration and manifold vacuum in chambers 48 and 62 instantly goes below the vacuum level in the timing chamber 64, the valve 71 will immediately close to block flow through the passage 70. Atmospheric air will then bleed into the pressure chamber 47, via the leak path previously described, to again cause a pressure differential to occur across the switching diaphragm 42 acting against the bias of spring 95 to again move the valve member 40 to the position shown in FIG. 1 in which position the valve member 40 blocks flow out through the secondary outlet 35 while permitting flow through the primary outlet 34 to the exhaust manifold. This happens providing the decrease in manifold vacuum does not go below the predetermined level that the spring 95 has been calibrated for. If manifold vacuum goes down to this predetermined level or below it, the valve member 40 will still be seated against the valve seat 36 blocking flow out through the primary outlet 34 to the exhaust manifold while permitting air flow out through the secondary outlet 35.

In the arrangement shown in FIG. 1, the air switching diverter valve 25 is connected for power mode use, that is, the secondary outlet 35 is connected by the conduit 28 for the discharge of secondary air to the air cleaner 12. Thus, as mounted for power mode use, the secondary air flow is diverted to the air cleaner 12 whenever engine manifold vacuum goes below some predetermined selected level, as previously described. This of course allows the air pressure to drop way down and thereby reduce the power needed to drive the air pump 22 and results therefore in more usable horsepower for the engine. On decelerations, the air switching diverter valve 25 will provide, in the manner previously described, the normal backfire protection to the exhaust manifold.

Although not shown, the air switching diverter valve 25 could alternately have its secondary outlet 35 connected by a suitable conduit, not shown, to the converter 20 or to the exhaust pipe 18 intermediate the exhaust manifold 17 and the converter. Such an arrangement may be desired on certain engine vehicle applications, since on large throttle openings, when manifold vacuum is low, it has been found advantageous for cooling and emissions to direct secondary air flow to the converter. It has also been found advantageous to bypass secondary air to the converter on decelerations while providing backfire protection to the exhaust manifold. Of course, as will be apparent, if the secondary outlet 35 is connected for discharge to the converter 20, the operation of the air switching diverter valve 25 would be as previously described. It will also be apparent to those skilled in the art that the secondary outlet 35 of the air switching diverter valve 25 could, if desired, be connected through suitable conduit means with a selector valve, not shown, whereby secondary air could be selectively discharged either to the air cleaner 12 or to the converter 20 in the manner described.

What is claimed is:

1. An air switching diverter valve for use with an internal combustion engine to control the flow of secondary air from an air pump to either the exhaust manifold of the engine or, to some other element associated with the engine or with the exhaust system for the engine, said air switching diverter valve including a valve housing having an inlet connectable to the air pump, a first outlet connectable to the exhaust manifold, a second outlet and a pressure valve controlled third outlet for the discharge of air above a predetermined pressure, a valve member mounted in said valve housing for movement between a first position blocking flow through said first outlet and a second position blocking flow through said second outlet, a vacuum actuated switching diaphragm assembly positioned in said valve housing and connected to said valve member and operative to effect movement of said valve member between said first position and said second position, said switching diaphragm forming with said valve housing a pressure chamber on one side thereof in communication via orifice passage means with the atmosphere and, on its other side, a vacuum chamber that is connectable to the induction system of the engine so as to be supplied with engine vacuum, a diverter timing assembly movably positioned in said vacuum chamber and attached at one end to said switching diaphragm for movement therewith, said diverter timing assembly including a housing means and a divert timing diaphragm and valve means which forms with said housing means a divert vacuum chamber that is in direct communication with said vacuum chamber and a timing chamber on opposite sides of said divert timing diaphragm and valve means, said switching diaphragm having a passage means therethrough whereby to effect communication between said pressure chamber and said divert vacuum chamber, a control valve being positioned to control flow through said passage means with one end of said control valve extending into said divert vacuum chamber in position to be engaged by said divert timing diaphragm and valve means, said divert timing diaphragm and valve means being operative to effect opening of said control valve during rapid engine decelerations.

2. An air switching diverter valve for use with an internal combustion engine having an induction system, an exhaust manifold and an engine driven air pump for supplying secondary air, said air switching diverter valve including a valve housing defining a valve chamber having an inlet connected to the air pump, a first outlet connected to the exhaust manifold, a second outlet and a third outlet to the atmosphere, said third outlet having a one-way pressure relief valve means positioned therein to control flow from said valve chamber out through said third outlet, said valve housing further including a first valve seat in said valve chamber surrounding said first outlet and a second valve seat axially opposed from said first valve seat surrounding said second outlet, a central apertured switching diaphragm, a cup-shaped cover secured to said valve housing at its end opposite said first outlet with said switching diaphragm sandwiched therebetween to define with said valve housing a pressure chamber and with said cup-shaped cover a vacuum chamber supplied with a vacuum signal from said induction system, orifice means connecting said pressure chamber to be in communication with the atmosphere, a valve member positioned in said valve chamber, a valve stem reciprocably journaled in said valve body with one end of said valve stem being connected to said valve member and its opposite end extending into said pressure chamber and operatively connected to said switching diaphragm for movement therewith, a divert timing assembly positioned in said vacuum chamber, said divert timing assembly including an upper divert housing secured to said switching diaphragm for movement therewith and a lower divert housing secured to said upper divert housing with a divert diaphragm and a divert timing valve positioned therebetween to form with said upper divert housing a second vacuum chamber in flow communication with said first vacuum chamber and with said lower divert housing a timing chamber in fluid communication through said divert valve means with said second vacuum chamber and valve controlled passage means connecting said pressure chamber to said second vacuum chamber, said valve controlled passage means including a valve journaled in said valve stem and projecting through said central aperture of said switching diaphragm for engagement by said divert timing means and operable to control the flow between said pressure chamber and said second vacuum chamber through said central aperture of said switching diaphragm, a first spring means being positioned in said second vacuum chamber to normally bias said divert timing valve means out of engagement with said valve and a second spring means positioned in said first vacuum chamber in position to normally bias said switching valve and therefore said valve member into seating engagement with said first valve seat.

3. An air switching diverter valve for use on an internal combustion engine having an induction system for air flow through the engine, a throttle in said induction system for controlling air flow therethrough, an exhaust system including an exhaust manifold for exhaust gas flow from the engine, and a pump for delivering secondary air, said air switching diverter valve including an upper housing having an inlet for receiving secondary air from said pump, a primary outlet for the discharge of air to said exhaust manifold and a secondary outlet aligned with said primary outlet, a valve member positioned in said upper housing for movement between a first position obstructing air flow through said primary outlet and a second position obstructing air flow through said secondary outlet, a lower housing secured to said upper housing, a switching diaphragm operatively connected to said valve member and secured between said upper housing and said lower housing to define a pressure chamber between said switching diaphragm and said upper housing, and a vacuum chamber between said switching diaphragm and said lower housing, said upper housing having orifice passage means therein for placing said pressure chamber in communication with the atmosphere, passage means in said lower housing connectable to said induction system downstream of said throttle whereby said vacuum chamber receives engine vacuum, a divert timing assembly positioned in said vacuum chamber, said divert timing assembly including an apertured upper divert housing secured to said switching diaphragm for movement therewith and a lower divert housing, a divert diaphragm and valve means secured between said upper divert housing and said lower divert housing to define a divert vacuum chamber between said divert diaphragm and valve means and said upper divert housing in direct communication with said vacuum chamber and a timing chamber between said divert diaphragm and valve means and said lower divert housing, said divert diaphragm and valve means having a bleed permitting restricted flow between said divert vacuum chamber and said timing chamber, a first spring positioned in said vacuum chamber and operative to normally bias said valve member to said first position, a spring biased valve controlled passage means through said switching diaphragm for the controlled communication between said pressure chamber and said vacuum chamber, said spring biased valve having a portion thereof extending into said divert vacuum chamber in position to be engaged by said divert diaphragm and valve means and a second spring positioned in said divert timing assembly to normally bias said divert diaphragm and valve means out of engagement with said spring biased valve, whereby said spring biased valve is normally operative to block flow between said pressure chamber and said vacuum chamber through said passage means.

4. An air switching diverter valve for use with an internal combustion engine having an induction system, an exhaust manifold and, an engine driven air pump for supplying secondary air, said air switching diverter valve including a housing means including an upper housing and a lower housing, a first diaphragm secured therebetween to form an upper pressure chamber and a lower vacuum chamber connectable to engine vacuum in the induction system, said upper housing having a central chamber therein with an inlet passage opening into said chamber and connectable to the air pump, a primary outlet opening at one end into said central chamber and connectable at its opposite end to the exhaust manifold, a secondary outlet opening at one end into said chamber diametrically opposite said one end of said primary outlet and a pressure relief valve controlled relief outlet opening at one end into said central chamber opposite said inlet passage, a guide bore in said upper housing coaxial with said one end of said secondary outlet and extending from said end of said upper housing forming part of said pressure chamber to said secondary outlet, a radial port in said upper housing opening at one end into said guide bore and at its other end being open to the atmosphere, a switching valve including a valve head with a valve stem depending therefrom that is loosely reciprocably journaled in said guide bore with the end of said valve stem opposite said valve head extending into said pressure chamber and connected to said first diaphragm, said valve head being positioned in said central chamber for movement between a second position in which said switching valve blocks flow through said secondary outlet and a first position in which said valve blocks flow through said primary outlet, said valve stem as loosely journaled in said guide bore forming therewith a clearance passage interconnecting said radial port to said pressure chamber, a divert housing positioned in said lower vacuum chamber, said divert housing including an upper cup portion secured to said first diaphragm on the side opposite said valve stem and a lower cup portion, a divert timing assembly, including a second diaphragm and timing valve controlled passage means operatively secured between said upper cup portion and said lower cup portion to form with said upper cup portion a second vacuum chamber and with said lower cup portion a timing chamber, said upper cup portion having aperture means therethrough whereby said second vacuum chamber is in direct communication with said lower vacuum chamber, said timing chamber being in fluid communication with said second vacuum chamber as controlled by said timing valve controlled passage means, a control passage extending through said first diaphragm and through a portion of said valve stem for connecting said upper atmospheric chamber to said second vacuum chamber, a spring biased control valve means being disposed in said control passage and normally positioned to block flow through said control passage, said control valve means including a depending stem portion extending into said second vacuum chamber to be in position for engagement by said divert timing assembly, a first spring means positioned in said second vacuum chamber to normally bias said divert timing assembly in a direction to be out of engagement with said stem portion and a second spring means positioned in said lower vacuum chamber to normally bias said first diaphragm and therefore said switching valve in a direction whereby said switching valve is moved to said first position.

* * * * *